US006284436B1

(12) United States Patent
Ahn et al.

(10) Patent No.: US 6,284,436 B1
(45) Date of Patent: Sep. 4, 2001

(54) METHOD OF MANUFACTURING A MICRO INJECTING DEVICE

(75) Inventors: Byung-Sun Ahn, Suwon (KR); Zukov Andrey Aleksandrovich; Dunaev Boris Nikolaevich, both of Moscow (RU)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/432,603

(22) Filed: Nov. 3, 1999

(30) Foreign Application Priority Data

Nov. 3, 1998 (RU) ..... 98119952

(51) Int. Cl.[7] ..... B41J 2/16
(52) U.S. Cl. ..... 430/320; 430/318; 430/319
(58) Field of Search ..... 430/320, 318, 430/319; 347/63, 64, 65

(56) References Cited

U.S. PATENT DOCUMENTS 4,480,259 10/1984 Kruger et al. .
4,490,728 12/1984 Vaught et al. .
4,809,428 3/1989 Aden et al. .
5,140,345 8/1992 Komuro .
5,198,834 3/1993 Childers et al. .
5,274,400 12/1993 Johnson et al. .
5,417,835 5/1995 Brown et al. .
5,420,627 5/1995 Keefe et al. .
5,665,249 * 9/1997 Burke et al. ..... 216/2
5,812,163 * 9/1998 Wong ..... 347/68
6,074,043 * 6/2000 Ahn ..... 347/54

* cited by examiner

*Primary Examiner*—John A. McPherson
(74) *Attorney, Agent, or Firm*—Robert E. Bushnell, Esq.

(57) ABSTRACT

The present invention relates to a micro-injecting device and a method of manufacturing the same. According to the present invention, a liquid chamber barrier layer and a first organic film layer are formed of solution including a soft polyamide acid. The soft polyamide acid solution is dried and heat treated under an appropriate condition to harden. When the soft polyamide acid solution is further treated at 280 to 300° C. and pressure of 0.5 to 2 kg/Cm$^2$, the soft polyamide acid solution acts as an adhesive. Accordingly, the liquid chamber barrier layer and the first organic film layer of the membrane which are based on and made of the soft polyamide acid solution, can be tightly combined with other construction without the combination progressive layer.

21 Claims, 13 Drawing Sheets

METHOD OF MANUFACTURING A MICRO INJECTING DEVICE

CLAIM OF PRIORITY

This application makes reference to, incorporates the same herein, and claims all benefits accruing under 35 U.S.C. §119 from an application for MICRO INJECTING DEVICE AND THE METHOD OF MANUFACTURING THE SAME earlier filed in the Rusian Federation Patent Office on Nov. 3, 1998 and there duly assigned Serial No. 98119952.

BACKGROUND OF THE INVENTION

1. Field of the Invention

The present invention relates to the field of micro-injecting devices and methods of a manufacturing the same.

2. Description of the Related Art

Generally, the term micro-injecting device refers to a device which is designed to provide printing paper, a human body or motor vehicles with a predetermined amount of liquid, for example, ink, injection liquid or petroleum using the method in which a predetermined amount of electric or thermal energy is applied to the above-mentioned liquid, yielding a volumetric transformation of the liquid. This method allows the application of a small quantity of a liquid to a specific object.

Recently, developments in electrical and electronic technology have enabled rapid development of such micro-injecting devices. Thus, micro-injecting devices are being widely used in daily life. One example of the use of micro-injecting devices in daily life is the inkjet printer.

The inkjet printer is a form of micro-injecting device which differs from conventional dot printers in the capability of performing print jobs in various colors by using cartridges. An additional advantage of inkjet printers over dot printers is the fine, clear letters produced on paper by the ink-jet printer. As a result, the use of inkjet printers is increasing.

An inkjet printer generally includes a micro-injecting device having nozzles with a minute diameter. The micro-injecting device discharges ink by transforming the liquid ink and expanding the ink to an air bubble according to electric signals from outside the printer, and thereby carries out the printing of letters and images on paper.

Examples of the construction and operation of several ink jet print heads of the conventional are seen in the following U.S. patents. U.S. Pat. No. 4,490,728, to Vaught et al., entitled Thermal Ink Jet Printer, describes a basic print head. U.S. Pat. No. 4,809,428, to Aden et al., entitled The Film Device For An Ink Jet Printhead and Process For Manufacturing Same and U.S. Pat. No. 5,140,345, to Komuro, entitled Method Of Manufacturing a Substrate For A Liquid Jet Recording Head And Substrate Manufactured By the Method, describe manufacturing methods for ink-jet printheads. U.S. Pat. No. 5,274,400, to Johnson et al., entitled Ink Path Geometry For High Temperature Operation Of Ink-Jet Printheads, describes altering the dimensions of the ink-jet feed channel to provide fluidic drag. U.S. Pat. No. 5,420,627, Keefe et al, entitled Ink Jet Printhead, shows a particular printhead design.

Generally, the micro-injecting device uses a high temperature generated by a heating resistor layer to discharge the ink on the paper. Accordingly, the high temperature which is generated by the heating resistor layer has an effect on ink contained in a liquid chamber for a long time. As a result, the ink is thermally transformed and this causes a decrease in the durability of an apparatus containing the ink.

Recently, to overcome this problem, there has been proposed a new method for smoothly spraying ink from the ink chamber toward the outside by disposing a plate membrane between the heating resistor layer and the ink chamber and inducing a dynamic deformation of the membrane under a pressure of a working fluid, for example, heptane. Since the membrane is disposed between the ink chamber and the heating layer, preventing the ink from contacting directly to the heating layer, the ink itself is subjected to little thermal transformation. An example of this type of printhead is seen in U.S. Pat. No. 4,480,259, to Kruger et al., entitled Ink Jet Printer With Bubble Driven Flexible Membrane.

In conventional membrane-containing micro-injecting devices, both ink and a working liquid are usually used in printing the letters and images. Therefore, separate chambers must be provided in the micro-injecting device to store the ink and the working liquid.

For this purpose, the micro-injecting device has a liquid chamber barrier layer and a heating chamber barrier layer formed in the device, which respectively define the chambers. The chambers contain the ink and the working liquid reliably.

Generally, the ink chamber barrier layer and the heating chamber layer are each more than 10 $\mu$m thick (deep) so that each chamber has sufficient volume. Organic materials are used as raw materials for both the ink and the working liquid for reasons of chemical compatibility.

As described above, since the chambers which are defined by the ink chamber barrier layer and the heating chamber layer must contain chemicals such as the ink and the working liquid, the chambers must have a high corrosion-resistance. The heating chamber barrier layer and the ink chamber barrier layer are corroded by the chemical when the chemical stays in the chambers for a long time. Accordingly, the heating chamber barrier layer and the ink chamber barrier layer may form gaps at boundaries between these layers and the nozzle plate or the membrane of the device.

In this case, the chemical which is contained in the chambers leaks from the chambers to construction which are not resistant to the chemical. The leakage of the chemical results in markedly degrading the general durability of the micro-injecting device.

Of note is the disclosure of U.S. Pat. No. 5,417,835, to Brown et al., entitled Solid State Ion Sensor With Polyimide Membrane, which discloses a sensor using a polyimide matrix membrane. In this membrane-containing device, which is quite different from a micro-injecting device, the membrane is made of polyimide, taking advantage of the excellent adherence characteristics of polyimide.

Also of note is a new method for preventing the leakage of the ink or the working liquid proposed to overcome the above problem U.S. Pat. No. 5,198,834, to Childers et al., entitled Ink Jet Print Head Having Two Cured Photoimaged Barrier Layers, discloses a method of preventing a leakage of an ink which is contained in ink chambers. According to this patent, a barrier wall include two layers, one layer a negatively acting photoimageable soldermask the second negatively acting lithographic photoresist. The second material is applied to adhesively couple the first layer to the orifice plate above. Thus the second layer serves as a progressive layer between the first, or base, layer and the orifice plate. As the attachment of the ink chamber barrier layer and a nozzle plate is improved by attaching the progressive layer of the ink chamber barrier layer to the nozzle plate, formation of a gap between the ink chamber barrier layer and the nozzle plate is prevented. The patent describes a first layer made of an epoxy acrylate and a second layer made of Waycoat SC is resist 900.

In this case, however, there is a disadvantage in that the number of processing steps is increased since the ink chamber barrier layer is comprised of two layers, the base layer and the progressive layer. Furthermore, when the ink chamber barrier layer is attached to the nozzle plate, the progressive layer inhibits the aligning of the ink chamber barrier layer and the nozzle plate. Accordingly, there is a problem in that the ink camber barrier layer may be not properly attached to the nozzle plate.

If the ink chamber barrier layer is not aligned to the nozzle plate, a misalignment may occur between the ink chamber barrier layer and the nozzle plate. Accordingly, a passageway for the ink may be partially obstructed by a disorder. That causes the ink not to be smoothly discharged. At a result, the printing performance of the ink jet printer head is markedly degraded.

SUMMARY OF THE INVENTION

It is therefore an object of the present invention to provide an improved micro-injecting device.

It is also an object of the present invention to provide a micro-injecting device in which the is heating chamber barrier layer and ink chamber barrier layer do not leak.

It is another object of the present invention to provide a micro-injecting device in which the ink is smoothly ejected.

It is a further object of the invention to provide an improved method of manufacturing a micro-injecting device.

It is a yet further object of the present invention to provide a method of manufacturing a micro-injecting device requiring fewer steps.

It is a still further object of the present invention to provide a manufacturing method in which the ink and liquid chamber barriers do not require an extra layer to ensure adhesion.

It is a yet still further object of the present invention to provide a manufacturing method which allows for proper alignment of the ink chamber barrier layer and the nozzle plate.

The present invention has been made to overcome the above-described problems of the prior art. To accomplish the above objects of the present invention, there is provided a micro-injecting device in which a first polyamide acid solution is made of compound in which 3,3'4,4'-tetracarboxydiphenyl oxide dianhydride is added to the mixture of 1,4-bis(4-aminophenoxy)benzene and an amide solvent at a predetermined ratio while forming a liquid chamber barrier layer.

The first polyamide acid solution is cured and hardened to a first polyimide, while maintaining a tightly adhesive force, by means of heat treatment under particular conditions of temperature and pressure, for example, in the range of approximately 280 to 300° C. and 0.5 to 2 kg/cm$^2$. Accordingly, the liquid chamber barrier layer made of the first polyimide acid can be tightly attached to other parts of the printhead. The first polyimide is relatively soft, due to a flexible polymer chain.

By using the first polyimide, even though ink has an effect on boundaries between the liquid chamber barrier layer and another constructions, leakage of the ink can be prevent out of liquid chambers. Furthermore, the first, soft, polyimide acid can be used for other constructions, such as a membrane and a heating chamber barrier layer. When the membrane is formed of this polyimide as a main component of the membrane, the membrane can be tightly combined with the heating chamber barrier layer without the need for a progressive layer as in the prior art. Accordingly, working solution which fills the heating chambers can be prevented from leaking out of the heating chambers.

Preferably, the heating chamber barrier layer is formed of a second polyamide acid solution which reacts to and is mixed with the soft polyimide acid solution so as to be tightly contacted with the membrane.

In the micro injecting device according to the present invention, as a result, the injection performance is remarkably improved.

BRIEF DESCRIPTION OF THE DRAWINGS

A more complete appreciation of the invention, and many of the attendant advantages thereof, will be readily apparent as the same becomes better understood by reference to the following detailed description when considered in conviction with the accompanying drawings in which like reference symbols indicate the same or similar components, wherein.

DETAILED DESCRIPTION OF THE PREFERRED EMBODIMENT

Figure 1:
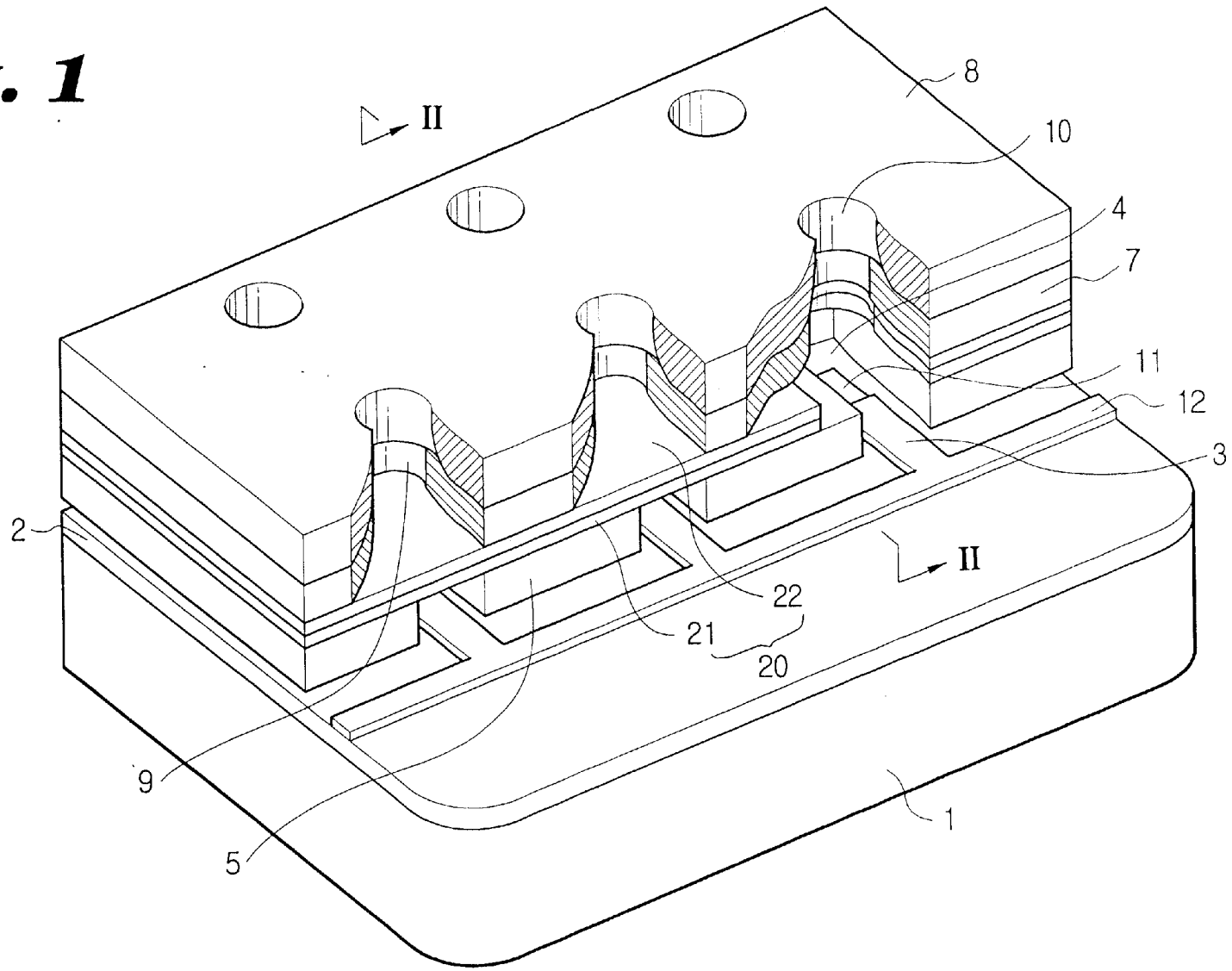
FIG. 1 is a perspective view of an ink-jet printer head according to the present invention.

Hereinafter, an ink-jet printer head and a method of manufacturing the same according to the present invention will be described in detail with reference to the accompanying drawings. As shown in FIG. 1, in the micro-injecting device according to the present invention, a protective film 2 made of $SiO_2$ is disposed to adhere to an upper surface of a base 1 made of silicon. Heating resistor layers 11 are disposed in place on an upper surface of the protective film 2, to which electric energy is applied from an outer electric source (not shown) so as to heat the heating resistor layers 11. An electrode layer 3 is disposed on an edge portion of each heating resistor layer 11, which supplies the electric energy for the heating resistor layers 11 from the outer electric source. Also, the electrode layer is connected with a common electrode 12. The electric energy which is supplied from the electric layer 3 for heating resistor layers 11 is transformed into a high temperature of a heat energy by means of the heating resistor layers 11.

Furthermore, a heating chamber 4 is defined by a heating chamber barrier layer 5 over the electrode resistors 11 so as to cover the heating resistor layers 11. Heat which is generated by each heating resistor layer 11 is transmitted into the heating chamber 4.

The heating chamber 4 is filled with working liquid which is facilitated to generate a vapor pressure. The working liquid is rapidly evaporated by the heat transmitted from the heating resistor layer 11. Also, the vapor pressure which is generated due to the evaporation of the working liquid is applied to a membrane 20 formed on the heating chamber barrier layer 5.

A liquid chamber 9 is defined by a liquid chamber barrier layer 7 over the membrane 20 so as to be coaxial with the heating chamber 4. The liquid chamber 9 is filled with a predetermined quantity of ink.

On the other hand, apertures are formed in the liquid chamber barrier layer 7 and a nozzle plate 8 so as to correspond to the liquid chambers 9. Such nozzles 10 are formed through the liquid chamber barrier layer 7 which defines the liquid chambers 9, and the nozzle plate 8 to be coaxial with the heating chambers 4 and the liquid chambers 9.

According to the present invention, the liquid chamber barrier layer 7 is made of a first, "soft", polyimide having the following structure:

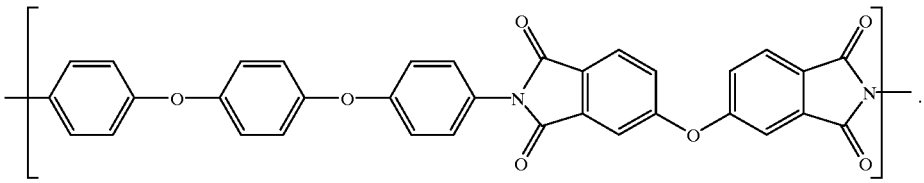

The first polyimide is formed from a corresponding first polyamide acid solution upon treatment at a certain temperature and pressure. As noted above, this polyimide is relatively "soft", with flexible polymer chains due to the ether linkage between the imide linkages.

Accordingly, when the liquid chamber barrier layer 7 is combined with the membrane 20, the liquid chamber barrier layer 7 is changed into a high adhesive substance at the certain temperature and pressure to have a high adhesive force between the membrane 20 and the liquid chamber barrier layer 7, without the need for a progressive layer as in the prior art.

The membrane 20 according to the present invention includes double layers of a first organic film layer 21 and a second organic film layer 22. The second organic film layer 22 which is contacted to the liquid chamber barrier layer 7 is made of a second polyamide acid solution which is able to react well with the first polyamide acid solution.

Upon curing, the second polyamide acid solution yields a second, "hard" polyimide of structure:

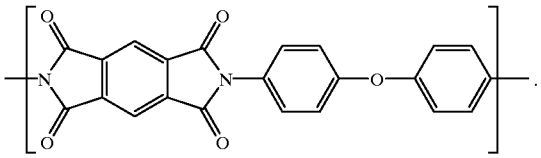

The second polyimide is "hard" relative to the first polyimide, with stiffer polymer chains due to the structure, in which there is little flexibility in the benzene between the polyimide linkages.

Since the liquid chamber barrier layer 7 is made of the first polyimide acid solution and the second organic film layer 22 of the membrane 20 is made of the second polyimide acid solution, the liquid chamber barrier layer 7 is tightly and stably connected with the second organic film layer of the membrane 20. Creation of a gap is prevented by the tight combination so that leakage of the ink contained in the liquid chamber 9 is prevented.

On the other hand, a first organic film layer 21 of the membrane 20 is made of the first polyimide acid solution, as is the liquid chamber barrier layer 7. This results in long-term maintenance of a high combination force between the first organic film layer 21 and the second organic film layer 22 which form the membrane.

Also, the reason for forming the first organic film layer 21 with the first, "soft", polyamide acid solution is that the heating chamber barrier layer 5 which contacts the first organic film layer 21 can be formed of the second "hard" polyamide acid solution which reacts well with the soft polyamide acid solution.

Since the heating chamber barrier layer 5 is made of the second, "hard", polyamide acid solution and the first organic film layer 21 of the membrane 20 is made of the first, "soft", polyamide acid solution, the heating chamber barrier layer 5 is tightly and stably linked with the first organic film layer 21 of the membrane 20. Creation of a gap is prevented by the tight combination so that leakage of the working solution contained in the heating chamber 4 is prevented.

Furthermore, the first organic film layer 21 of the membrane 20 is made of the first polyamide acid solution, as is the liquid chamber barrier layer 7. When the heating chamber barrier layer 5 is combined with the membrane 20, the heating chamber barrier layer 5 is changed into the highly adhesive substance at the certain temperature and pressure to maintain a high combination force between the membrane 20 and liquid camber barrier layer 7 without the need for a progressive layer.

Preferably, the first, soft, polyamide acid solution which forms the liquid chamber barrier layer 7 and the first organic film layer 21, are made of compound in which 3,3',4,4'-tetracarboxydiphenyl oxide dianhydride is added to the mixture of 1,4-bis(4-aminophenoxy)benzene and an amide solvent at a predetermined ratio.

The structure of 1,4-bis(4-aminophenoxy)benzene is as follows:

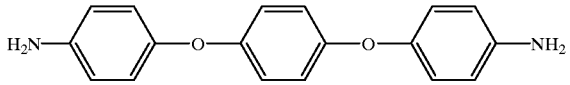

The structural formula of 3,3',4,4'-tetracarboxydiphenyl oxide dianhydride is as follows:

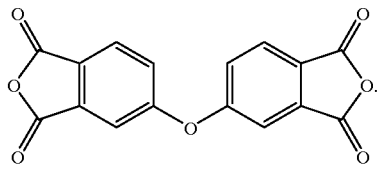

In the micro-injecting device according to the conventional art, the progressive layer is formed through a separate process to improve the contact force between liquid chamber barrier layer and other parts of the micro-injecting device. As a result, the number of steps in making the micro-injecting device are markedly increased.

In the present invention, the liquid chamber barrier layer 7 is formed of the first polyamide acid solution which is able to be changed into a cohesive substance under certain conditions. Also, The liquid chamber barrier layer 7 keeps a high combination force with other parts without the need for a progressive layer. As a result, the number of steps of the process can be reduced.

As described above, according to the present invention, the membrane 20 is combined with the heating chamber barrier layer 5 by using the reaction characteristic of the first polyamide acid solution and the second polyamide acid solution so that the durability of the micro-injecting device can be improved. Also, leakage of the working liquid out of the heating chambers can be prevented.

Figure 2:
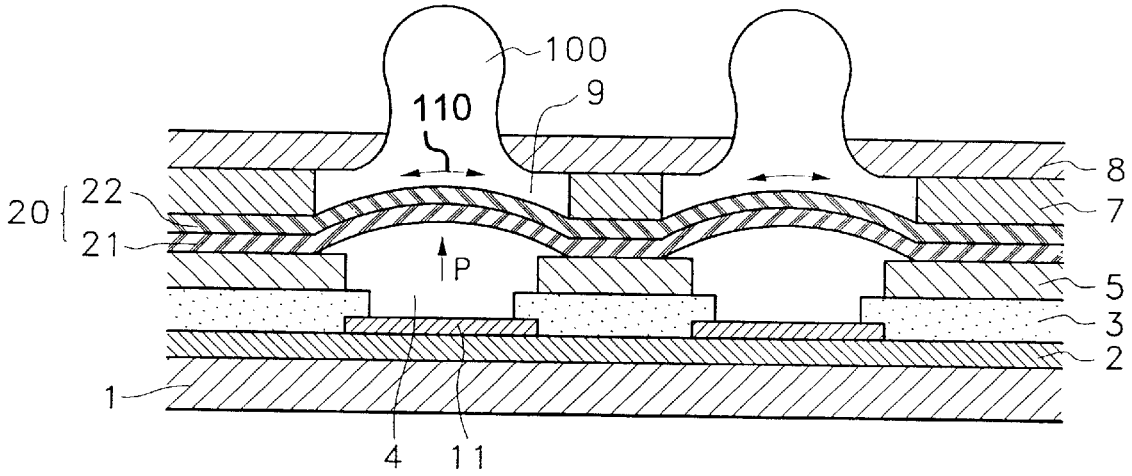
FIG. 2 is a cross-sectional view along II—II of FIG. 1 of the micro injecting device according to the present invention, which shows a first operation of the micro injecting device.
Figure 3:
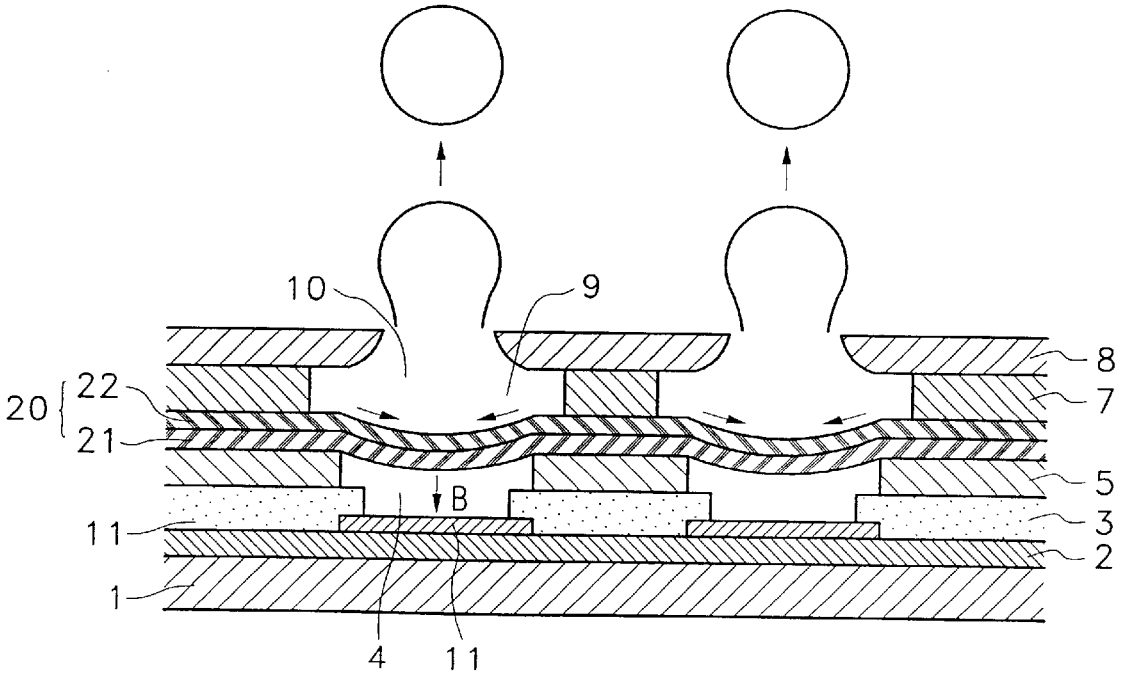
FIG. 3 is a cross-sectional view of the micro injecting device according to the present invention, which is a second operation of the micro injecting device.

Hereinafter, the operation of a micro-injecting device according to the present invention described above will be described. Referring to FIG. 2, firstly, when electric energy is applied to an electrode layer 3 from an external electric source, the heating resistor layer 11 which is connected to the electrode layer 3 is supplied with the electric energy. At the same time, the heating layer 11 is instantly heated to a high temperature, approximately 500° C. In this state, the electric energy is transformed into 500~550° C. of heat energy. Then, the heat energy is transmitted to the heating chamber 4 connected to the heating resistor layer 11, and the working liquid filling the heating chamber 4 is rapidly vaporized by the heat energy so as to generate a predetermined pressure of a vapor.

As described above, the heating chamber barrier layer 5 defining the heating chambers 4 is formed of the second, hard polyimide. The first organic film layer 21 which comes into contact with the heating chamber barrier layer 5 is formed from a first polyamide acid layer which has a desired reaction characteristic with the second polyimide. Accordingly, leakage of the working solution out of the heating chambers can be prevented as the heating chamber barrier layer 5 tightly contacts the first organic film layer 21.

The vapor pressure is transmitted toward the membrane 20 which is disposed on the surface of the heating chamber barrier layer 5, thereby applying a predetermined impact force P to the membrane 20. In this case, the membrane 20 is rapidly expanded outward, being bent as indicated by arrows 110. Accordingly, the impact force P is applied to ink 100 which fills the liquid chamber 9 defined on the membrane 20 so that the ink 100 is in the state of being injected.

The liquid chamber barrier layer 7 also is formed from the first polyamide acid solution. While the liquid chamber barrier layer 7 is assembled with the membrane 20, the liquid chamber barrier layer 7 is transformed into a cohesive substance as the pressure is applied to the liquid chamber barrier layer 7 at the predetermined temperature. Accordingly, the liquid chamber barrier layer 7 can be tightly combined with the membrane 20 without a progressive layer.

As shown in FIGS. 4*a*–4*j*, when the supply of the electric energy from the external electric source to the heating resistor layer 11 is stopped, the heating resistor layer 11 is cooled so that the pressure in the heating chamber 4 is rapidly decreased. Accordingly, the heating chamber 4 is in a vacuum state. The membrane 20 is bent by a reaction force B corresponding to the vacuum pressure due to the vacuum state in the heating chamber 4. Accordingly, the membrane 20 instantly contracts to return to the initial state.

In this case, the membrane 20 is rapidly contracted to transmit the reaction force toward the liquid chamber, as indicated by arrow B. Accordingly, the ink 100 which is in the situation for being injected by the expansion of the membrane 20 is transformed by the ink's own weight into a drop and then injected on a paper for printing. The paper is printed with drops of the ink injected from the micro-injecting device.

Hereinafter, a method of manufacturing the inkjet printer head according to the present invention will be described in detail The method of manufacturing the ink-jet printer head according to the present invention includes three processes which are carried out separately. The heating resistor 11 and the heating chamber barrier layer 5 assembly, the membrane 20, and an assembly of the nozzle plate 8 and the liquid chamber barrier layer 7, which are manufactured in the separate steps are aligned with each other and assembled, thereby accomplishing the making of the micro-injecting device.

As shown in FIGS. 4*a*–4*j*, according to the method of the present invention, in the first process, firstly a metal 11', for example poly silicon, is vapor-deposited on a base plate 1 which has a protective film 2 of $SiO_2$ coated thereon. After the photo mask 30 is coated on the poly silicon 11', a step of exposing the photo mask 30 to light is carried out by using an ultraviolet source 40 and a lens 50. At this time, pattern cells 30' which correspond to the plane shape of the heating resistor layers 11 are formed in the photo mask 30. Then, ultraviolet light emitted from the ultraviolet source 40 is transmitted through the pattern cells 30' to form the pattern of the heating resistor layer 11 on the poly silicon 11'.

Figure 4A:
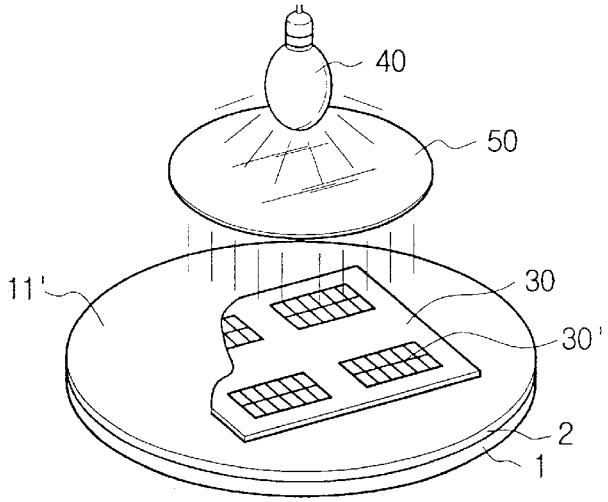
FIGS. 4*a* to 6*f* show the order of assembling the micro injecting device according to a method of manufacturing the same of the present invention.
Figure 4B:
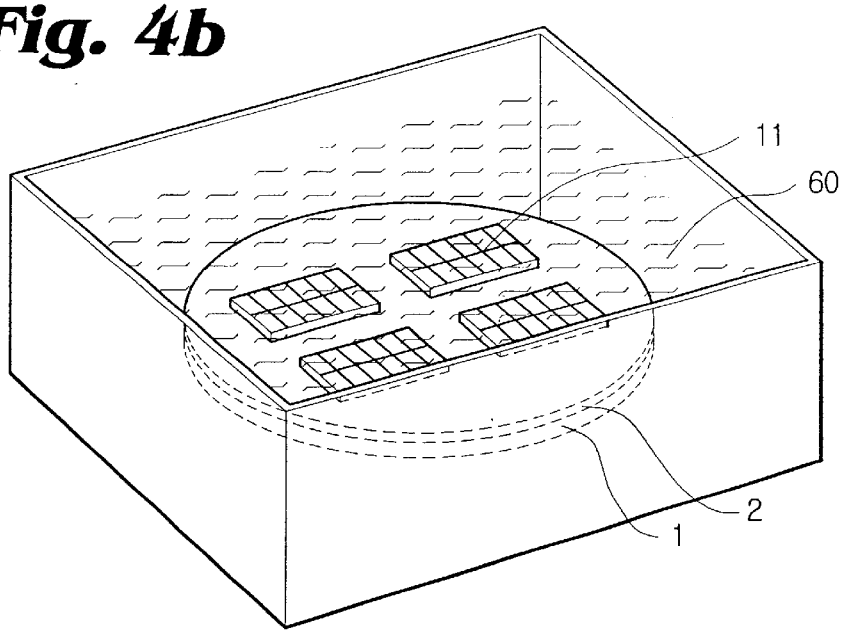

As shown in FIG. 4*b*, after the photo mask 30 is removed from the base plate 1 by a chemical, the base plate 1 is placed in a developing chamber 60 filled with developer. During the developing of the base plate 1, the silicon portion of the base plate 1 which is not exposed to the ultraviolet light due to the presence of the pattern cell 30' remains on the base plate 1 in spite of being contacting the developer. The rest portion of the base plate 1 which is exposed to the s ultraviolet light is removed from the base plate 1 by the developer. Accordingly, the heating resistor layer 11 having the same shape as the pattern is finally formed on the protective film of the base plate 1.

Figure 4C:
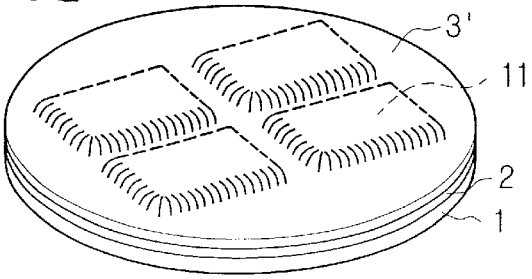
Figure 4D:
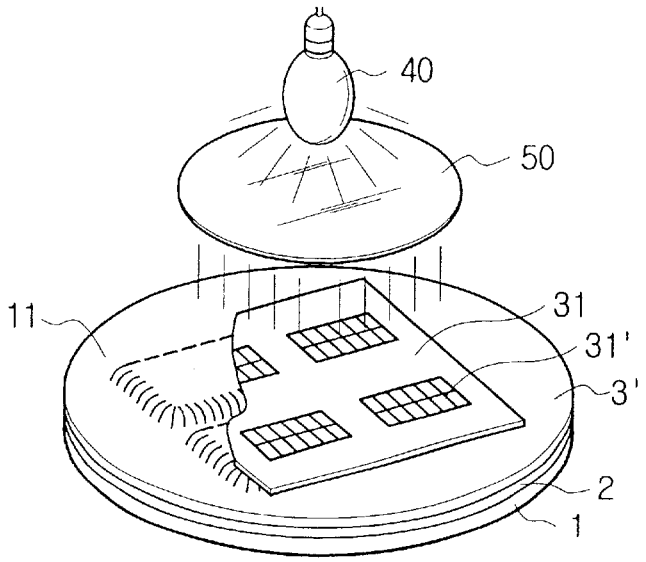

Referring to FIG. 4*c*, by using vapor deposition such as sputtering, a metal such as aluminum is deposited on the protective film 2 to cover the heating resistor layer 11 so that the metal layer 3' is formed on the base plate 1. As shown in FIG. 4*d*, after a photo mask 31 is coated on the metal layer 3', the metal layer 3' is exposed to the ultraviolet light by using the ultraviolet source 40 and the lens 50. At this time, desired pattern cells 31' are formed in the photo mask 31, which have a shape of electrode layer 3. The ultraviolet light emitted from the ultraviolet source 40 is transmitted through the pattern cells 31' to form the patterns of the electrode layer 3 on the metal layer 3'.

Figure 4E:
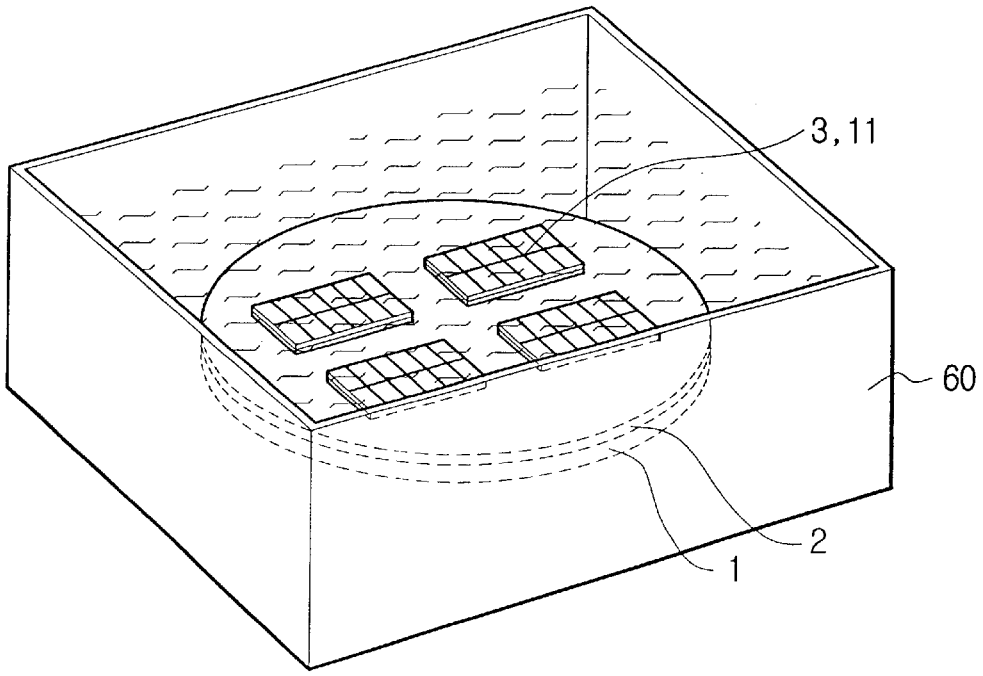
Figure 7A:
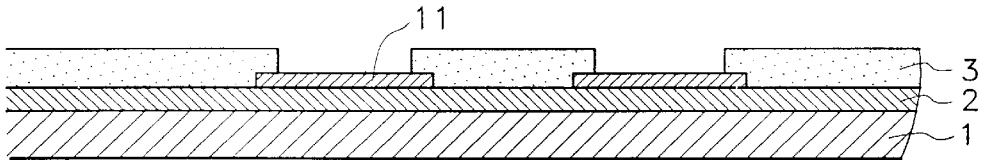
FIGS. 7*a* to 7*f* show a process of manufacturing the micro-injecting device according to the present invention.

As shown in FIG. 4*e*, after the photo mask 31 is removed from the metal layer 3' by using the chemical, the base plate 1 on which the heating layer 11 and the metal layer 3' are arranged is placed in a developing chamber 60 which is filled with developer. During the developing of the metal layer 3', the portion of the metal layer 3' which is not exposed to the ultraviolet light remains on the base plate 1 in the shape of the pattern 31', while the rest of the metal layer 3' which is exposed to the ultraviolet light is removed from the metal layer 3' by the developer. As shown in FIG. 7*a,* the electrode layer 3 is formed on the metal layer 3' so as to only contact the edge of the heating resistor layer 11.

Figure 4F:
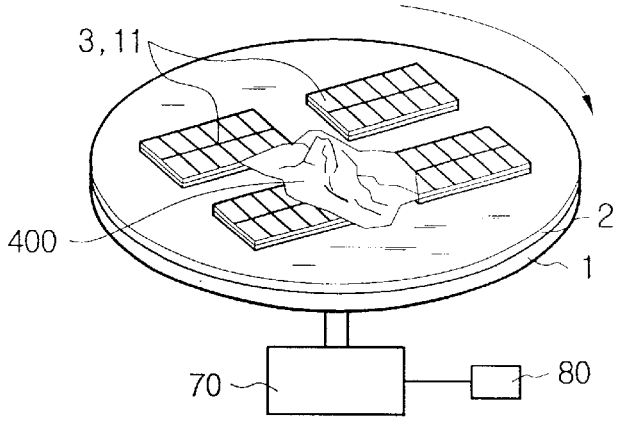

After the base plate 1 is washed with distilled water, as shown in FIG. 4*f;* the second polyamide acid solution 400 is coated by a coating device (not shown) on the heating resistor layer 11 and the electrode layer 3 while rotating the base plate 1 by a spinner 70. The rotating velocity of the spinner 70 having the base plate 1 thereon is controlled by the controller 80.

Figure 4G:
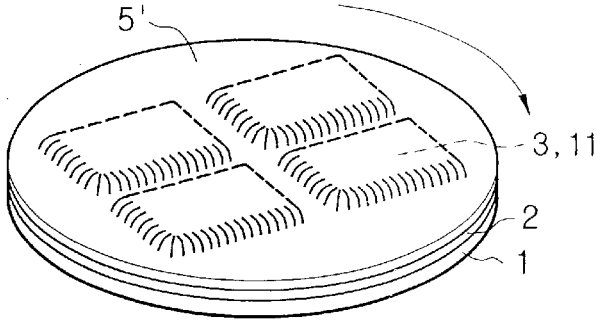

Accordingly, the second polyamide acid solution 400 is evenly distributed over the electrode layer 3 by a centrifugal force. The hard polyamide acid solution 400 forms waves due to the viscosity thereof. As shown in FIG. 4*g,* the hard polyamide acid solution forms a first organic solution layer 5' of even thickness on the base plate 1 while covering the heating resistor layer 11 and the electrode layer 3.

Figure 4H:
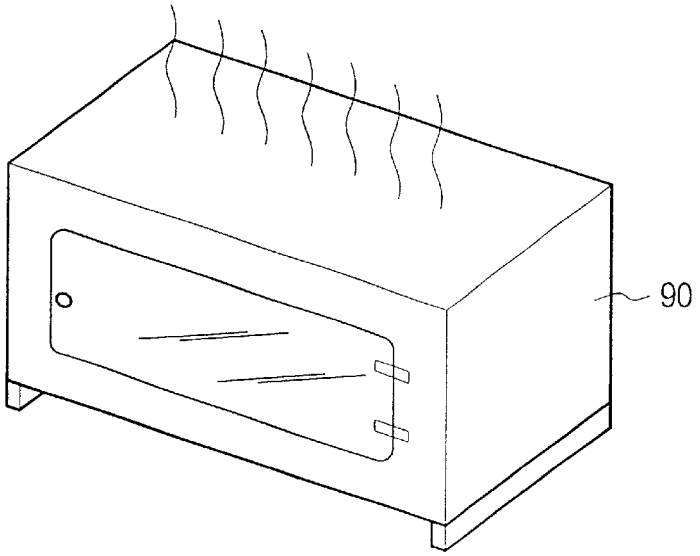

As shown in FIG. 4*h,* then, after the base plate 1 having the first organic solution layer 5' is moved from the spinner 70 to a heating tank 90, the first organic solution layer 5' is dried and heat-treated in the heating tank 90. As a result, the first organic solution layer 5' is transformed into the heating chamber barrier layer 5.

In the case as described above, since the heating chamber barrier layer 5 is formed of the second polyamide acid solution 400, the heating chamber barrier layer 5 will come into tight contact with the first organic film layer 21 of the membrane 20 which is formed of the soft polyamide acid solution during the assembly of the micro-injecting device. The second, "hard", polyamide acid solution which forms the heating chamber barrier layer has such a structure as described and shown above.

Figure 4I:
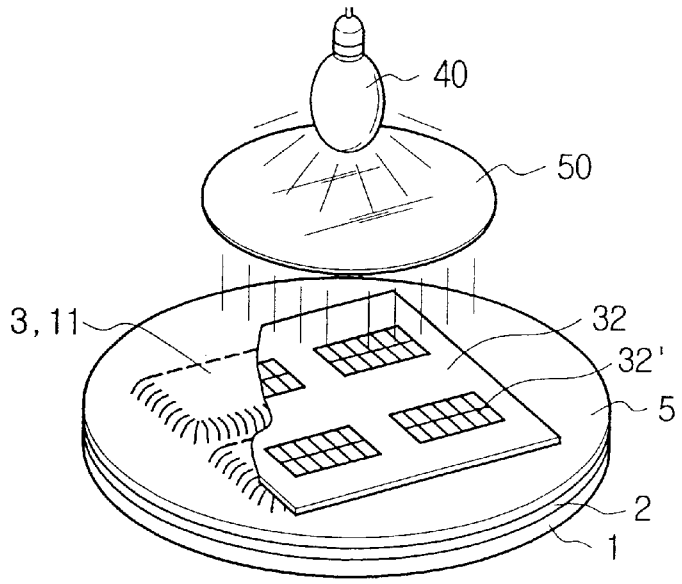

As shown in FIG. 4*i* after a photo mask 32 is coated on the heating chamber barrier layer 5, the heating chamber barrier layer 5 is exposed to the ultraviolet light by using the ultraviolet source 40 and the lens 50. At this time, desired pattern cells 32' are formed in the photo mask 32, which have a shape of the heating chamber 4. The ultraviolet light emitted from the ultraviolet source 40 is transmitted through the pattern cells 32' to form the patterns of the heating chamber 4 on the heating chamber barrier layer 5.

Figure 4J:
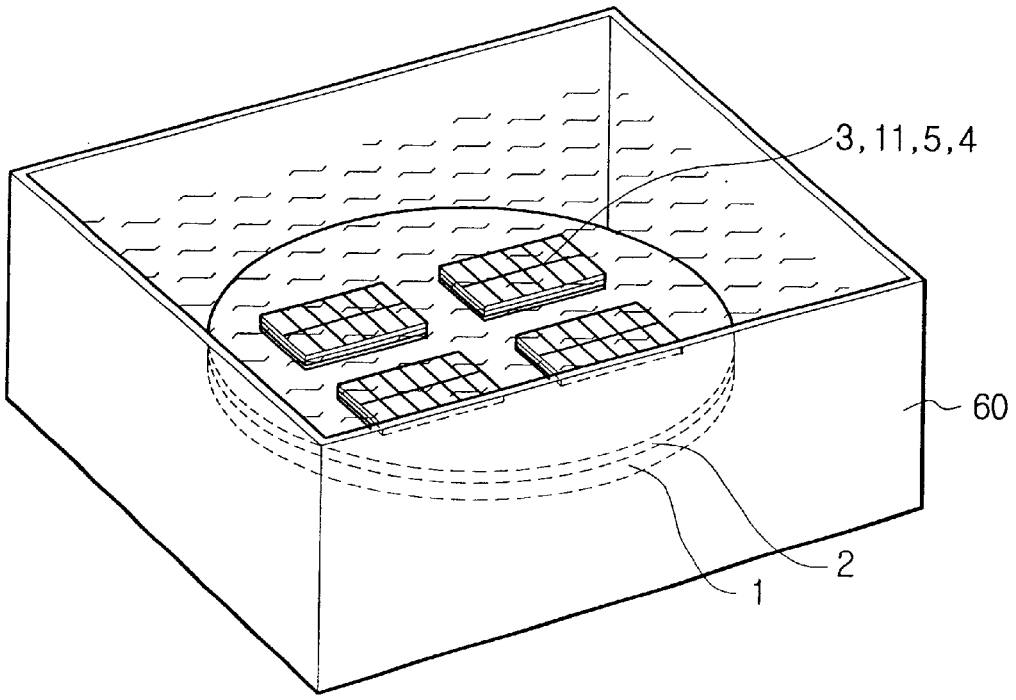
Figure 7B:
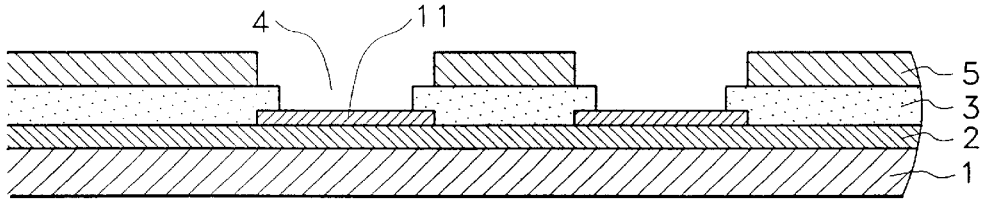
Figure 7C:
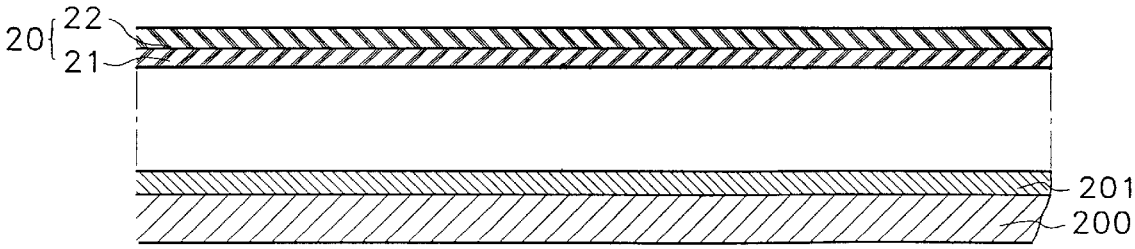
Figure 7D:
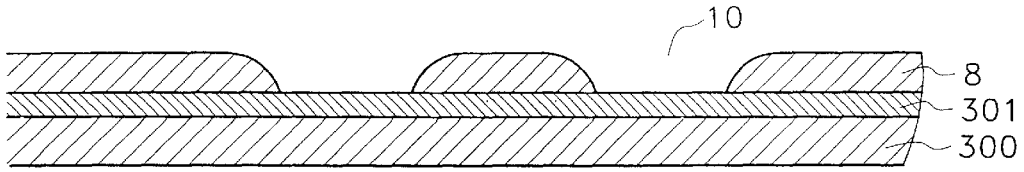

As shown in FIG. 4*j,* next, after the photo mask 32 is removed from the heating chamber barrier layer 5 by using the chemical, the base plate 1 on which the heating resistor layer 11, the metal layer 3', and the heating chamber barrier layer 5 are arranged, is placed in a developing chamber 60 which is filled with the developer. During the developing of the heating chamber barrier layer 5, the portion of the heating chamber barrier layer 5 which is not exposed to the ultraviolet light remains on the base plate 1 due to the shape of the pattern 32', while the rest of the heating chamber barrier layer 5 which is exposed to the ultraviolet light is removed from the base plate 1 by the developer. Therefore, as shown in FIG. 7*b,* the heating chamber barrier layer 5 is formed on the electrode layer 3 so as to be contacted with the edge of the heating resistor layer 11. As described above, the first steps of manufacturing the micro-injecting device according to the present invention are completed.

The second process for making the membrane 20 is practiced separately from the first process. As shown in FIGS. 5*a*–5*e,* the first, "soft", polyamide acid solution 500 is coated by a coating device on a silicon base plate 200 having a protective film 201 of $SiO_2$ thereon while rotating the base plate 200 by a spinner 70. The rotating velocity of the spinner 70 having the base plate 200 thereon is controlled by the controller 80.

Accordingly, the first polyamide acid solution 500 is evenly distributed over the electrode layer 3 by a centrifugal force. The first polyamide acid solution 500 flows due to its viscosity. A second organic solution layer 21' of even thickness is formed from the second polyamide acid solution on the base plate 200.

Figure 5A:
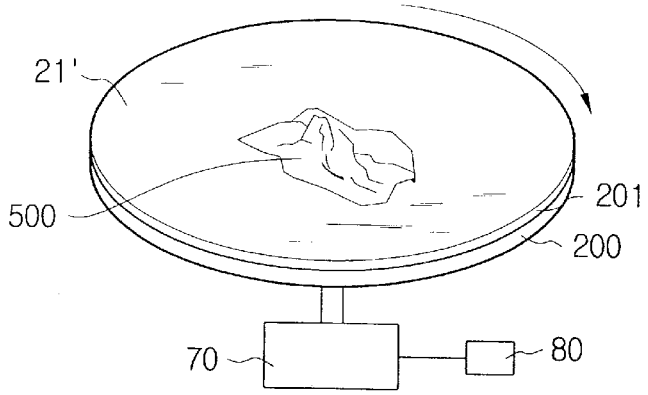
Figure 5B:
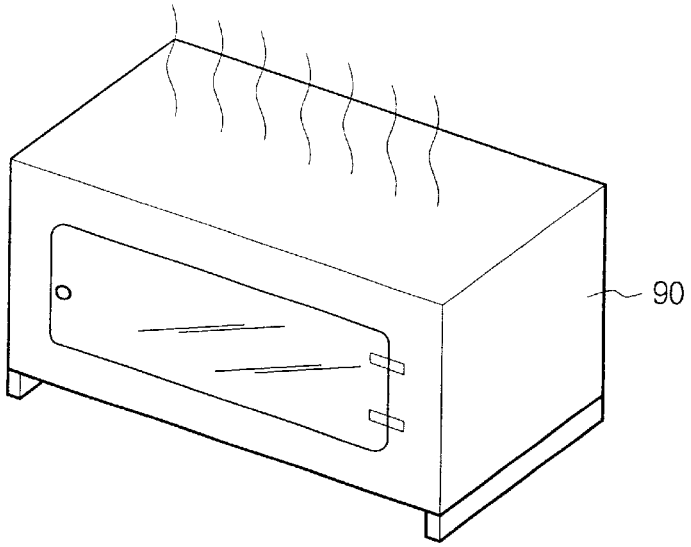

As shown in FIG. 5*b,* then, after the base plate 200 having the second organic solution layer 21' is carried from the spinner 70 to a heating tank 90, the second organic solution layer 21' is dried and heat-treated in the heating tank 90. As a result, the second organic solution layer 21' is rapidly transformed into a first organic film 21 of the membrane 20.

In this step of transforming the second organic solution layer 21' into the first organic film layer 21, it is preferable to maintain a drying temperature of in the range of approximately 80 to 100° C. and for in the range of approximately 15 to 20 minutes of drying time. Also, in this step, it is preferable to perform the heat treatment at a temperature of in the range of approximately 170 to 180° C. for in the range of approximately 20 to 30 minutes.

In the case as described above, since the first organic film layer 21 is formed of the first polyamide acid solution 500, the first organic film layer 21 comes into tight contact with the heating chamber barrier layer 5 which is formed of the second polyamide acid solution 400 during the assembling of the micro-injecting device. The first polyamide acid solution 500 which forms the first organic layer 21 has such a structure as described above.

Figure 5C:
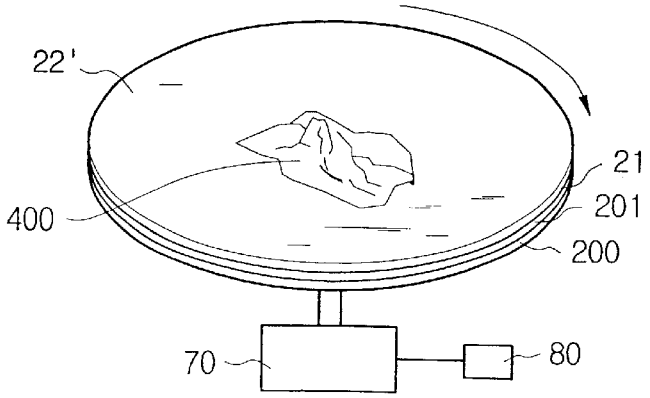

As shown in FIG. 5*c,* the second polyamide acid solution 400 is coated by a coating device on a base plate 200 having the first organic film layer 21 thereon while rotating the base plate 200 by the spinner 70. The rotating velocity of the spinner 70 having the base plate 200 thereon is controlled by the controller 80.

Accordingly, the second polyamide acid solution 400 is evenly distributed over the first organic film layer 21 by a centrifugal force. The second polyamide acid solution 400 flows due to a viscosity thereof. As a result, a third organic solution layer 22' is formed on the first organic film layer 21 to have the thickness evenly.

Figure 5D:
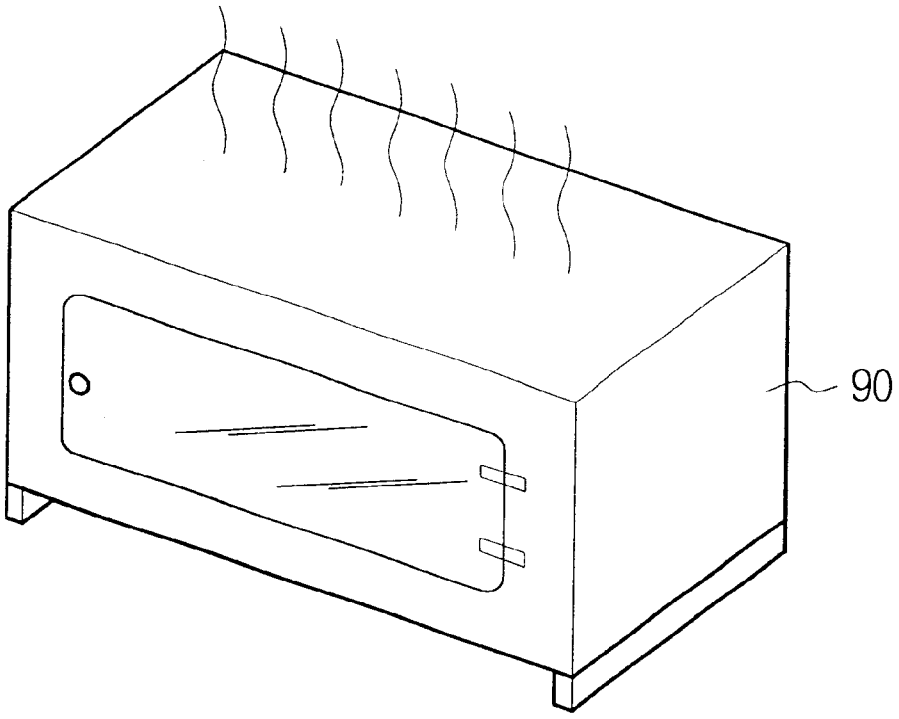

As shown in FIG. 5*d,* then, after the base plate 200 on which the second organic film layer 21 and the third organic solution layer 22' are arranged is carried from the spinner 70 to a heating tank 90, the third organic solution layer 22' is dried and heat-treated in the heating tank 90. As a result, the third organic solution layer 22' is rapidly transformed into a second organic film layer 22 of the membrane 20.

In the case as described above, since the second organic film layer 22 is formed of the second, "hard", polyamide acid solution 400, the second organic film layer 22 comes into tight contact with the first organic film layer 21 which is formed of the first, "soft", polyamide acid solution 500. The second polyamide acid solution 400 which forms the second organic film layer 22 has a chemical structure as described above. Furthermore, since the second organic film layer 22 is formed of the second polyamide acid solution 400, the second organic film layer 22 can be tightly attached to the liquid chamber barrier layer 7 which is formed of the first polyamide acid solution 500.

Figure 5E:
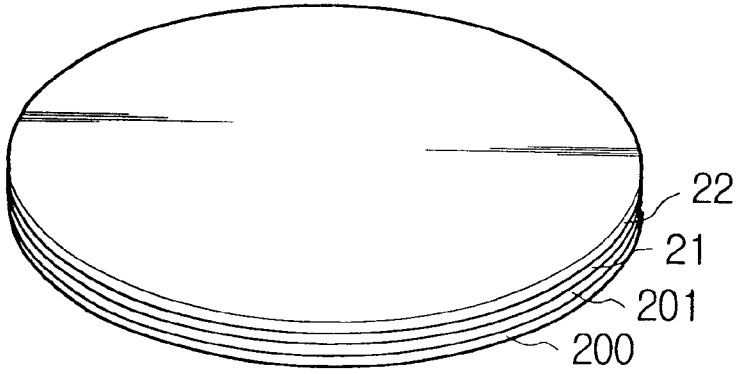

By these steps, the membrane 20 on which the first and second organic film layers 21 and 22 are stacked, is formed on the base plate 200 having the protective film 201, as shown in FIG. 5*e*. After a structure of the membrane 20 is completed as described above, the membrane 20 is separated from the base plate 200 by using a chemical such as HF. Accordingly, the second process for making the membrane is completed.

Figure 6A:
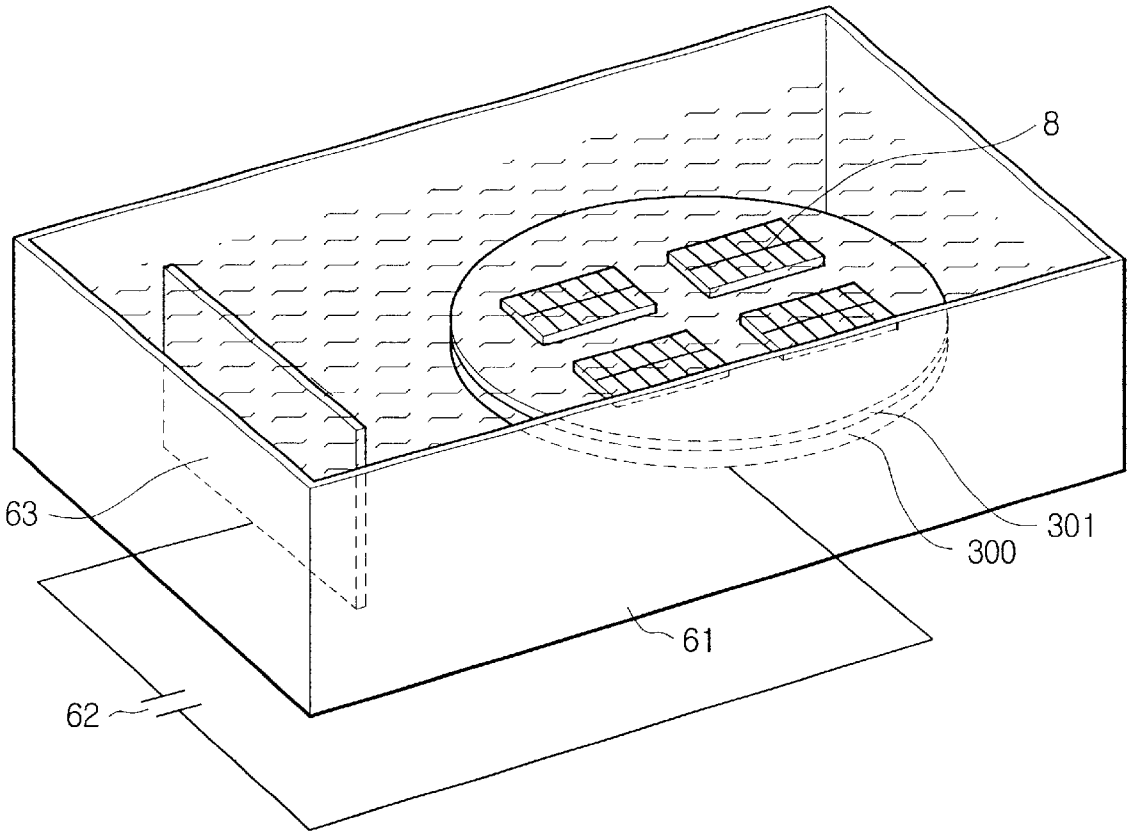

The third process of making an assembly of the nozzle plate 8 and the liquid chamber barrier layer 7 is practiced separately from the second process. As shown in FIG. 6*a,* a silicon based plate 300 having a protective film 301 of $SiO_2$ is placed in an electroplating bath 61 which contains electrolyte.

The a pattern base layer (not shown) is formed on the base plate 300 to define a nozzle region during the making of the nozzle plate 8. In the electroplating bath, a target plate 63 of metal, such as nickel is placed along with the base plate 300. The base plate 300 and the target plate 63 are connected to an external electric source 62 in such a manner that the target plate 63 is connected to the positive electrode of the electric source 62 and the base plate 300 connected to the negative electrode.

As the electricity is applied to the target plate 63 and the base plate 300, the target plate 63 which is connected to the positive electrode of the electric source is dissolved and ionized rapidly to generate nickel ions. The nickel ions which are ionized move through the electrolyte to the base plate 300 which is connected to the negative electrode of the electric source. Accordingly, the base plate 8 is plated with nickel ions in such a manner that the nickel ions are attached to a surface of the nozzle plate 8 and a nozzle portion of the patterned base layer.

Figure 6B:
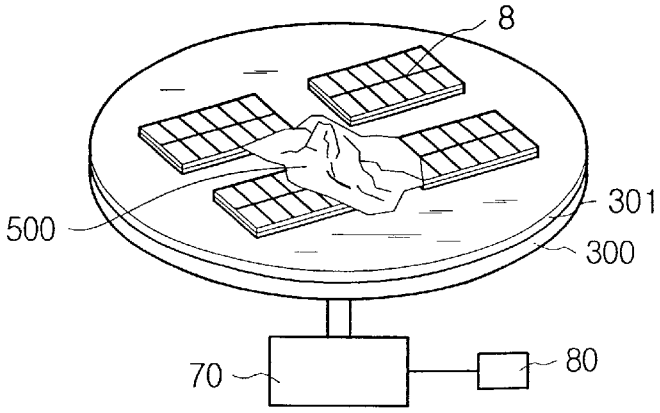
Figure 6C:
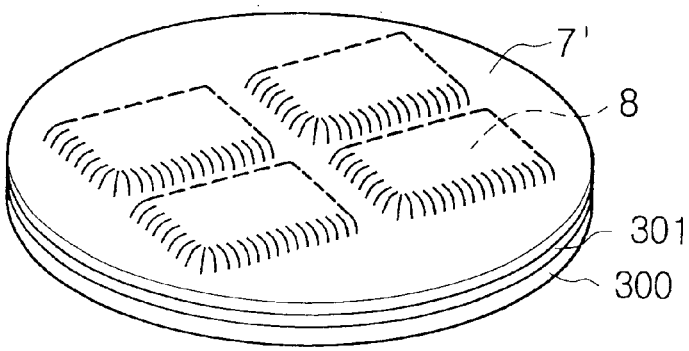

As shown in FIG. 6*b,* the first polyamide acid solution 500 is coated by a coating device on the base plate 300 having the nozzle plate 8, while rotating the base plate 300 by a shiner 70. The rotating velocity of the spinner 70 having the base plate 300 thereon is controlled by the controller 80.

Accordingly, the first polyamide acid solution 500 is evenly distributed over the base plate 300 by a center al force. The first polyamide acid solution 500 flows due to its viscosity. A fourth organic solution layer 7' is thus formed evenly on the base plate 300.

Figure 6D:
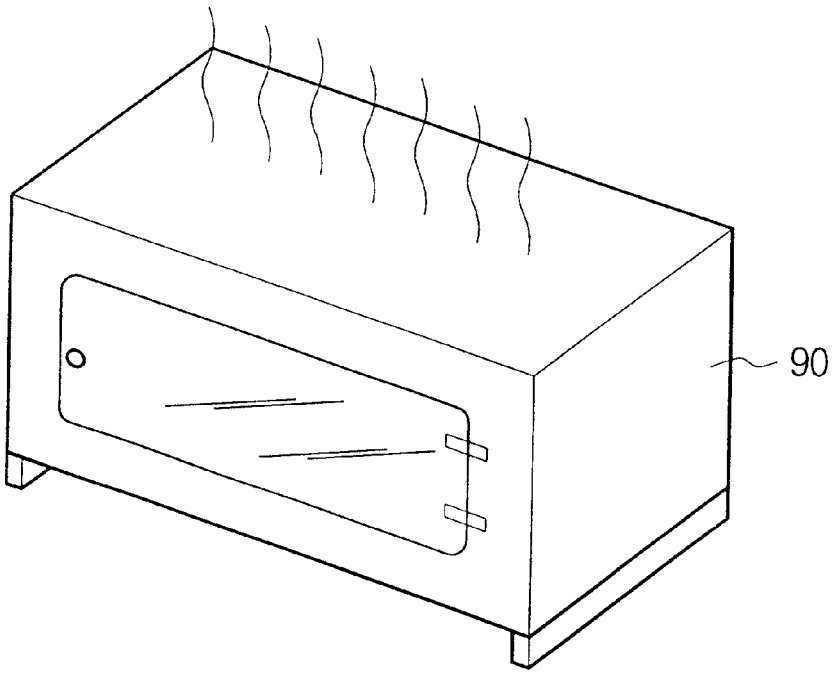

As shown in FIG. 6*d,* then, after the base plate 300 having the fourth organic solution layer 7' is carried from the spinner 70 to the heating tank 90, the fourth organic solution layer 7' is dried and heat-treated in the heating tank 90. As a result, the fourth organic solution layer 7' is rapidly transformed into a liquid chamber barrier layer 7.

In this step of transforming the fourth organic solution layer 7' into the liquid chamber barrier layer 7, it is preferable to maintain a drying temperature in the range of approximately 80 to 100° C. for in the range of approximately 15 to 20 minutes of drying time. Also, in this step, it is preferable to perform the heat-treatment at a temperature in the range of approximately 170 to 180° C. for in the range of approximately 20 to 30 minutes of heat treatment time.

In the case as described above, since the liquid chamber barrier layer 7 is formed of the first, "soft", polyamide acid solution 500, the liquid chamber barrier layer 7 comes into tight contact with the second organic fill layer 22 of the membrane 20 which is formed of the second, "hard", polyamide acid solution 400 during the assembling of the inkjet printer head. The first polyamide acid solution 500 which forms the liquid chamber barrier layer 7 has such a chemical structure as described above.

Figure 6E:
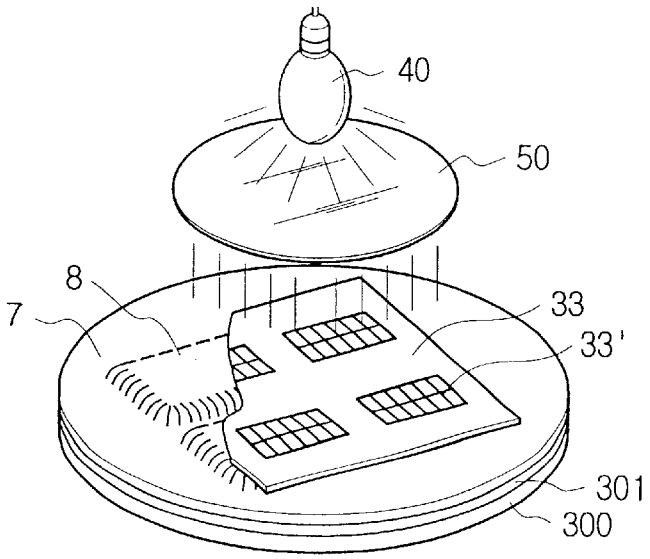

As shown in FIG. 6*e,* after a photo mask 33 is coated on the liquid chamber barrier layer 7, the liquid chamber barrier layer 7 is exposed to the ultraviolet light by using the ultraviolet source 40 and the lens 50. At this time, desired pattern cells 33' are formed in the photo mask 33, which have a shape of liquid chambers 9. The ultraviolet light emitted from the ultraviolet source 40 is transmitted through the pattern cells 33' to form the patterns of the liquid chamber 9 on the liquid chamber barrier layer 7.

Figure 6F:
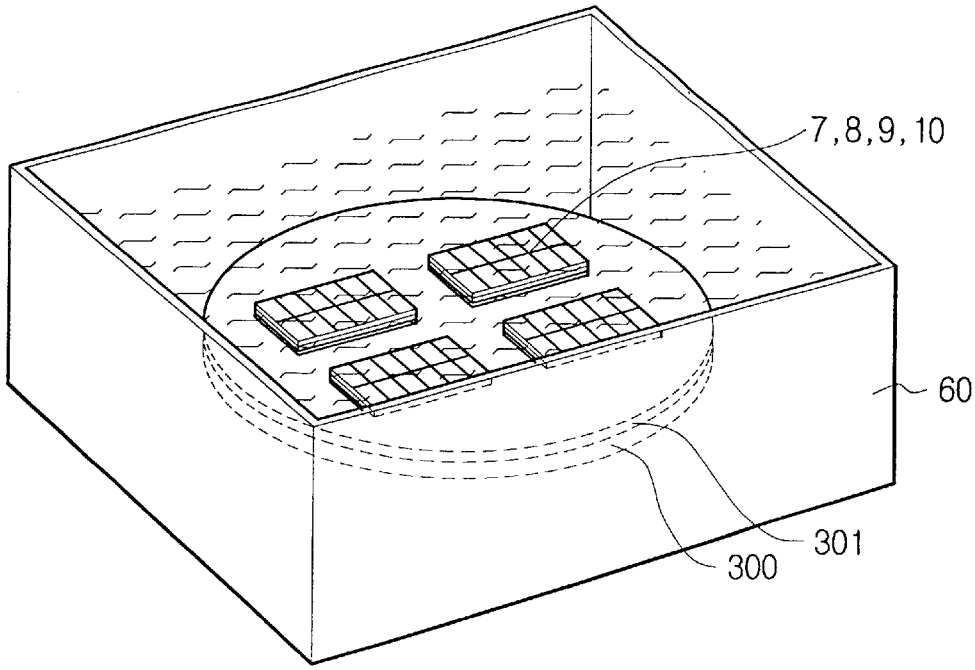
Figure 7E:
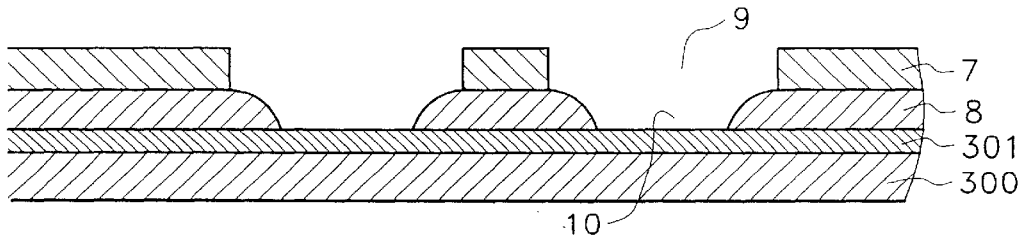

As shown in FIG. 6*f,* after the photo mask 33 is removed from the liquid chamber barrier layer 7 by using the chemical, the base plate 300 on which the nozzle plate 8 and the liquid chamber barrier layer 7 are piled up in order is placed in the developing chamber 60 which is filed with the developer. During the developing of the liquid chamber barrier layer 7, the portion of the liquid chamber layer 7 which is not exposed to the ultraviolet light remains on the nozzle plate 300 according to the shape of the pattern 33', while the rest of the liquid chamber barrier layer 7 which is exposed to the ultraviolet light is removed from the nozzle plate 8 by the developer. As shown in FIG. 7*e,* the liquid chamber barrier layer 7 is formed on the nozzle plate 8 so that the liquid chambers 9 respectively are aligned with the nozzles 10. When the nozzle plate 8 and the liquid chamber barrier layer 7 assembly is finished, the nozzle plate 8 and the liquid chamber barrier layer 7 assembly is separated from the base plate 300 by using the chemical, such as HF so as to complete the third process.

After the first, second, and third processes are completed, the inkjet printer head is assembled from the elements produced in these processes. Specifically, the membrane 20 formed in the second process is assembled with the base plate having the heating resistor layer 11 and the heating chamber barrier layer 5 arranged thereon. Then, the assembly of the nozzle plate 8 and the liquid chamber barrier layer 7 is disposed on and combined with the membrane 20 in such a manner that the heating chamber 4, the membrane 20, the liquid chamber 9, and the nozzle 10 are aligned to be coaxial with each other.

When the membrane 20 formed in the second process is assembled with the base plate having the heating resistor layer 11 and the heating chamber barrier layer 5 arranged thereon, it is preferable to maintain a pressure in the range of approximately 0.5 to 2 $kg/cm^2$ and a temperature in the range of approximately 250 to 350° C.

In this case, since the second organic film layer 21 of the membrane 20 is formed of the first, "soft", polyamide acid solution 500, the second organic film layer 21 is transformed into a cohesive substance under the above pressure and temperature. Accordingly, the second organic film layer 21 can be tightly combined with the heating chamber barrier layer 5 without the combination processing layer. As a result, the number of manufacturing steps can be reduced.

Also, when the assembly of the nozzle plate 8 and the liquid chamber barrier layer 7 which is made in the third steps is combined with the membrane 20 formed in the second steps, it is preferable to maintain pressure in the range of approximately 0.5 to 2 $kg/cm^2$ and temperature in the range of approximately 250 to 350° C.

In this case, since the liquid chamber barrier layer 7 is formed of the first polyamide acid solution 500, the liquid chamber barrier layer 7 is transformed into a cohesive substance under the above pressure and temperature. Accordingly, the liquid chamber barrier layer 7 can be tightly combined with the second organic film layer 21 of the membrane 20 without the need for a progressive layer. As a result, the number of steps can be reduced.

Figure 7F:
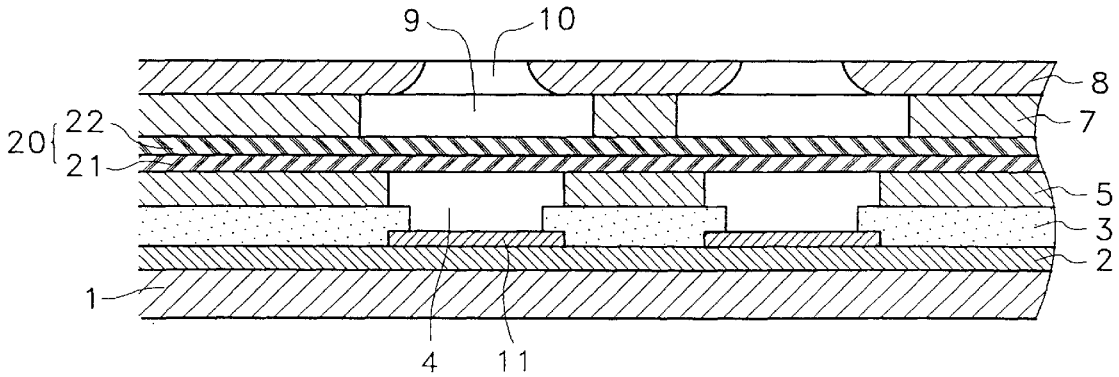

The constructions which are completed in the fist to third processes are assembled with each other while being aligned. As shown in FIG. 7*f,* the manufacturing of the ink-jet printhead can be accomplished.

As described above, since the liquid chamber barrier layer and the first organic film layer of the membrane are formed of the first, "soft" polyamide acid solution, the liquid chamber barrier layer and the first organic film layer are transformed to a cohesive substance under the certain pressure and temperature. Accordingly, the liquid chamber barrier layer and the first organic film layer can be tightly combined with another construction without the combination processing layer to prevent the leakage of the ink and the working liquid.

While the present invention bas been particularly shown and described with reference to the ink-jet printer head, it will be understood that the micro injecting device of the present invention can be applied to a micro pump of medical appliance and a fuel injector.

In the ink-jet printer head and the method of manufacturing the same, as described above in detail, the liquid chamber barrier layer, the first organic film layer, and the like are formed of soft polyamide acid solution. The soft polyamide acid solution is hardened under a certain heat treatment condition, but has an adhesive characteristic under pressure in the range of approximately 0.5 to 2 kg/cm$^2$ and temperature in the range of approximately 250 to 350° C. Accordingly, the liquid chamber barrier layer and the first organic film layer which are formed of the first polyamide acid solution can be tightly combined with another constructions without the combination processing layer to prevent the leakage of the ink and the working liquid.

While the present invention has been particularly shown and described with reference to a particular embodiment thereof, it will be understood by those skilled in the art that various changes in form and detail may be effected therein without departing from the scope of the invention as defined by the appended claims.

What is claimed is:

1. A method of manufacturing a micro-injecting device, comprising the steps of:

forming a membrane by the steps of:

spin-coating a first polyamide acid solution on a protective film on a base plate to form a first organic film;

drying and heat-treating the first organic film to form a first organic layer;

spin-coating a second polyamide solution of different chemical composition from said first polyamide acid solution on said first organic layer to form a second organic film;

drying and heat-treating the second organic film to form a second organic layer; and detaching the first organic layer and second organic layer as a membrane from the base plate;

forming a heating resistor/heating chamber barrier layer assembly by the steps of:

forming a heating resistor layer on a protective layer on a second base plate;

forming an electrode layer contacting the heating resistor layer;

spin-coating the second polyamide solution on the heating resistor layer and protective layer to form a third organic film;

drying and heat-treating the third organic film to form a third organic layer; and photo-etching the third organic layer to form a heating chamber barrier layer having heating chambers;

forming a nozzle plate/liquid chamber barrier layer assembly by the steps of:

forming a nozzle plate on a protective film on a third base plate;

spin-coating said first polyamide acid solution on said nozzle plate to form a fourth organic film;

drying and heat-treating the fourth organic film to form a fourth organic layer;

photo-etching the fourth organic layer to form a liquid chamber barrier layer having a liquid chamber; and separating the nozzle plate/liquid chamber barrier layer assembly from the third base plate;

aligning the membrane with the heating resistor layer/heating chamber barrier assembly with said first organic layer touching said heating chamber barrier layer, and assembling at an elevated temperature and pressure to form a first assembly; and aligning the nozzle plate/liquid chamber barrier layer assembly with said first assembly, with said liquid chamber barrier layer touching said second organic layer and assembling at an elevated temperature and pressure to complete the micro-injection device.

2. The method of claim 1, said step of forming the heating resistor layer further comprising depositing a metal on the protective layer and photo-etching the metal.

3. The method of claim 2, said first polyimide composition comprising a repeating group containing the structure,

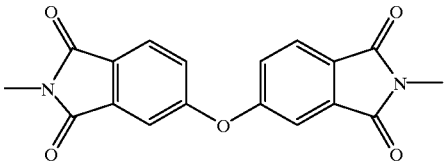

for providing flexibility to the polymer.

4. The method of claim 2, said first polyimide acid solution forming, upon curing, the polyimide repeating group:

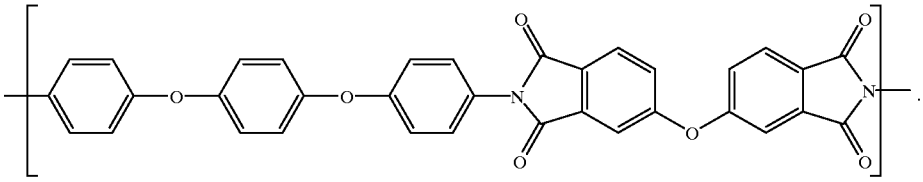

5. The method of claim 2, said first polyamide acid composition having the characteristic of forming a polyimide composition with a strong adhesive bond to said second polyimide composition upon said heat and pressure treatment.

6. The method of claim 2, said first polyamide acid composition being formed from 1,4-bis(4-aminophenoxy) benzene; 3,3',4,4'-tetracarboxydiphenyl oxide dianhydride; and an amide solvent.

7. The method of claim 2, said second polyimide acid solution forming, upon curing, the polyimide repeating group:

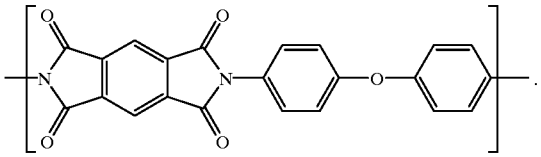

8. The method of claim 2, said heating chamber barrier layer being made of said second polyimide composition.

9. The method of claim 1, said step of forming the electrode layer further comprising depositing a metal on the protective film and heating resistor layer and photo-etching the metal.

10. The method of claim 1, said step of drying and heating the first organic film comprising:

drying the film at a temperature in the range of approximately 80 to 100° C. for in the range of approximately 15 to 20 minutes; and heat-treating at a temperature in the range of approximately 170 to 180° C. for in the range of approximately 20 to 30 minutes.

11. The method of claim 1, said step of drying and heating the second organic film comprising:

drying the film at a temperature in the range of approximately 80 to 100° C. for in the range of approximately 15 to 20 minutes; and heat-treating at a temperature in the range of approximately 170 to 180° C. for in the range of approximately 20 to 30 minutes.

12. The method of claim 1, said step of drying and heating the third organic film comprising:

drying the film at a temperature in the range of approximately 80 to 100° C. for in the range of approximately 15 to 20 minutes; and heat-treating at a temperature in the range of approximately 170 to 180° C. for in the range of approximately 20 to 30 minutes.

13. The method of claim 1, said step of drying and heating the fourth organic film comprising:

drying the film at a temperature in the range of approximately 80 to 100° C. for in the range of approximately 15 to 20 minutes; and heat-treating at a temperature in the range of approximately 170 to 180° C. for in the range of approximately 20 to 30 minutes.

14. The method of claim 1, said first polyamide acid solution forming, upon curing, the polyimide comprising the repeating group.

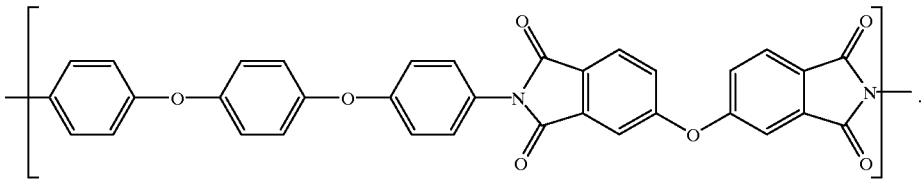

15. The method of claim 1, said second polyamide acid solution forming, upon curing, the polyimide comprising the repeating group

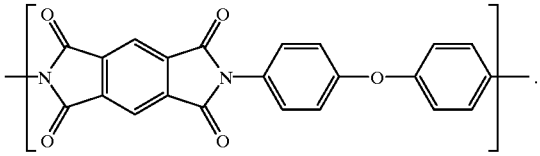

16. The method of claim 1, said first polyamide acid solution being formed from 1,4-bis(4-aminophenoxy) benzene; 3,3',4,4'-tetracarboxydiphenyl oxide dianhydride; and an amide solvent.

17. The method of claim 1, further comprising use of a first polyamide acid composition having the characteristic of forming a polyimide composition with a strong adhesive bond to said second polyimide composition under said elevated temperature and pressure.

18. The method of claim 1, said first polyimide composition comprising a repeating group containing the structure,

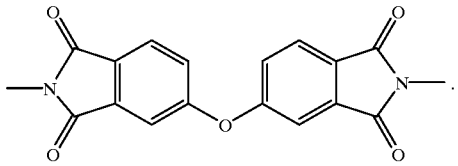

19. The method of claim 1, said step of forming the first assembly comprising assembling at a temperature in the range of approximately 250 to 300° C. and a pressure in the range of approximately 0.5 to 2 kg/cm$^2$.

20. The method of claim 1, said step of completing the micro-injection device comprising assembling at a tempera ture in the range of approximately 250 to 300° C. and a pressure in the range of approximately 0.5 to 2 kg/cm$^2$.

21. The method of claim 1, said step of forming the nozzle plate further comprising:

forming a pattern base layer on the third base plate; and electroplating nickel onto the pattern base layer to form the nozzle plate.

* * * * *